US007010887B2

(12) United States Patent
Walters

(10) Patent No.: US 7,010,887 B2
(45) Date of Patent: Mar. 14, 2006

(54) MOUNTING STRUCTURE AND METHOD FOR ARCUATE GUTTER TROUGHS

(75) Inventor: A. B. Walters, Georgetown, TX (US)

(73) Assignee: Senox Corpration, Austin, TX (US)

( * ) Notice: Subject to any disclaimer, the term of this patent is extended or adjusted under 35 U.S.C. 154(b) by 0 days.

(21) Appl. No.: 10/117,755

(22) Filed: Apr. 5, 2002

(65) Prior Publication Data

US 2003/0188493 A1 Oct. 9, 2003

(51) Int. Cl.
*E04D 13/00* (2006.01)

(52) U.S. Cl. ..... 52/11; 248/48.2

(58) Field of Classification Search ..... 52/11, 52/12, 15; 248/48.2, 18.2
See application file for complete search history.

(56) References Cited

U.S. PATENT DOCUMENTS

| | | | | | |
|---|---|---|---|---|---|
| 836,012 | A | * | 11/1906 | Cassen | |
| 1,803,154 | A | * | 4/1931 | Vail | |
| 2,271,081 | A | * | 1/1942 | Layton | |
| 3,067,881 | A | * | 12/1962 | Goosmann | |
| 3,333,803 | A | * | 8/1967 | Landis | |
| 5,575,118 | A | * | 11/1996 | Vahldieck | 52/11 |
| 5,706,608 | A | * | 1/1998 | Sweet | 52/11 |
| 6,493,993 | B1 | * | 12/2002 | Serano | 52/12 |

* cited by examiner

*Primary Examiner*—Carl D. Friedman
*Assistant Examiner*—Yvonne M. Horton
(74) *Attorney, Agent, or Firm*—Andrews Kurth LLP; J. Scott Denko

(57) ABSTRACT

The present invention provides an apparatus and methods for curved troughs used in gutter systems. An arcuate trough is formed with a mounting structure that employs two folds, with one fold disposed between the other fold and the outer surface of the trough.

7 Claims, 6 Drawing Sheets

PRIOR ART

PRIOR ART

MOUNTING STRUCTURE AND METHOD FOR ARCUATE GUTTER TROUGHS

TECHNICAL FIELD

The present invention relates to rain and run-off collection and diversion systems and, in particular, to rain collection trough designs.

BACKGROUND OF THE INVENTION

Diversion of rain from buildings is a well-known and beneficial practice. For centuries, architects and builders have understood the benefits of diverting rain to forestall erosion, maintain structural stability, and preserve vegetation. In recent decades, a multitude of systems have been developed to divert rain from structures and homes. Typically, such systems have been placed beneath or adjacent to the roofline to allow collection and diversion of rain accumulated from across the surface area of the structure roof. Such systems are sometimes called "gutter" systems.

Typical gutter systems employ a trough structure that is either open along its length or covered by a deflector or hood to inhibit the collection of debris that would otherwise be swept into the system by the collected water. Gutter system troughs often exhibit a cross-sectional shape known as the "o-gee" (i.e., "OG"). Other gutter systems may employ troughs that are arcuate in shape with what is known as "half-round" being a common shape for such arcuate troughs.

When bearing the weight of accumulated water, arcuate troughs and, in particular, half-round troughs are less stable than the OG style trough. An OG trough has a flattened backside that supports the weight of accumulated water. In contrast, a trough with a curved back wall area contacts a small area of the facia board or other mounting surface of the building from which runoff is collected. Consequently, the force of the accumulated water weight is concentrated in a smaller area. Typically, most of the weight of a curved trough is borne at the site of attachment or, specifically, around the location where the mounting fastener penetrates the back wall of the trough. This is particularly true where the back mounting area of the trough is curved and lacks the flat rear mounting surface of an OG. In a trough with a curved mounting area, over time, the trough will tend to sag and may even pull from the facia board or other mounting surface to which it has been attached. These structural instabilities arise from the shape of arcuate troughs employed in gutter and rain collection systems.

What is needed therefore is an arcuate trough design that contemplates the loads imposed by the weight of water accumulated in the trough and provides added stability and load bearing capacity while retaining the aspect of curvature preferred by same.

SUMMARY OF THE INVENTION

The present invention provides an apparatus and methods for curved troughs used in gutter systems. An arcuate trough is formed with a mounting structure that employs two folds, with one fold disposed between the other fold and the outer surface of the trough.

DESCRIPTION OF PREFERRED EMBODIMENTS

The term "arcuate" is to be understood to mean curved. For example, many gutter troughs are fashioned in what is called in the trade a "half-round" style. This is but one example of an arcuate trough. Other gutter troughs where the trough perimeter is curved in the mounting area of the trough should also be considered within the general category of arcuate troughs.

Figure 1:
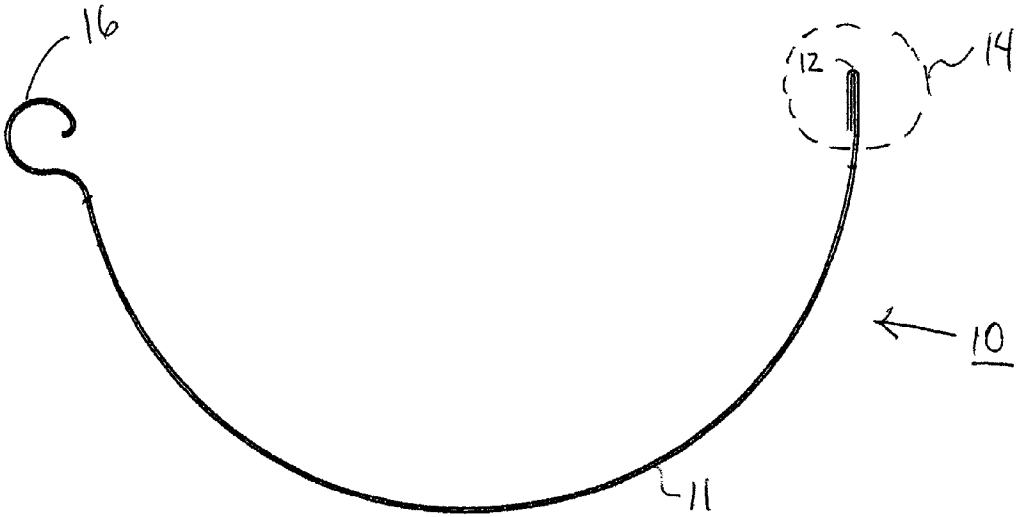
FIG. 1 depicts a prior art arcuate trough typically employed in gutter systems.
Figure 2:
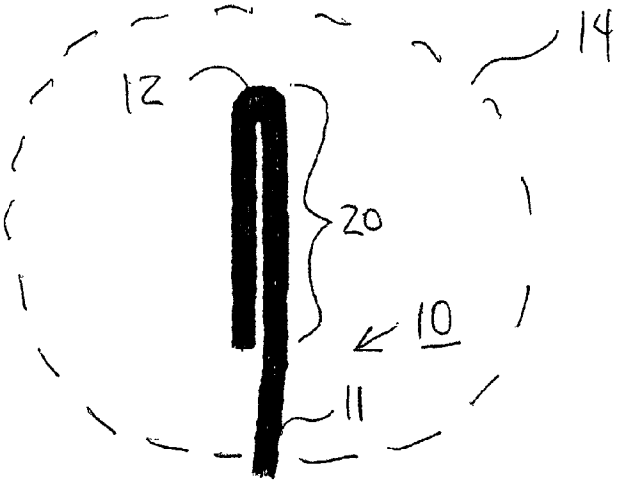
FIG. 2 depicts a prior art mounting area for the prior art trough of FIG. 1.

FIG. 1 depicts a prior art half-round trough 10 composed of trough material 11 shaped to have a rear lip 12 in a mounting area 14 and a front lip 16. Mounting area 14 of trough 10 is depicted in enlargement in FIG. 2. As shown, rear lip 12 is devised by folding over trough material 11 to create a double thickness mount field 20. A fastener then passes through mount field 20 to attach trough 10 to the building from which runoff is diverted. The fold is either inward toward the inside of the trough as shown or outward against the backside of the trough. In practice, although creation of a mount field 20 by folding trough material 11 over to double the material thickness at the point of attachment provides some added strength, it does not prevent sagging. Trough 10 will typically exhibit a tendency to sag or shift as, over time, the weight of borne water pulls the structure downward with more force than the mechanics of the trough mounting can reliably bear. As those of skill in the field recognize, the problem of weight-caused sag becomes more acute in larger troughs as the mechanical level arm through which the weight is applied increases downward forces.

Figure 3:
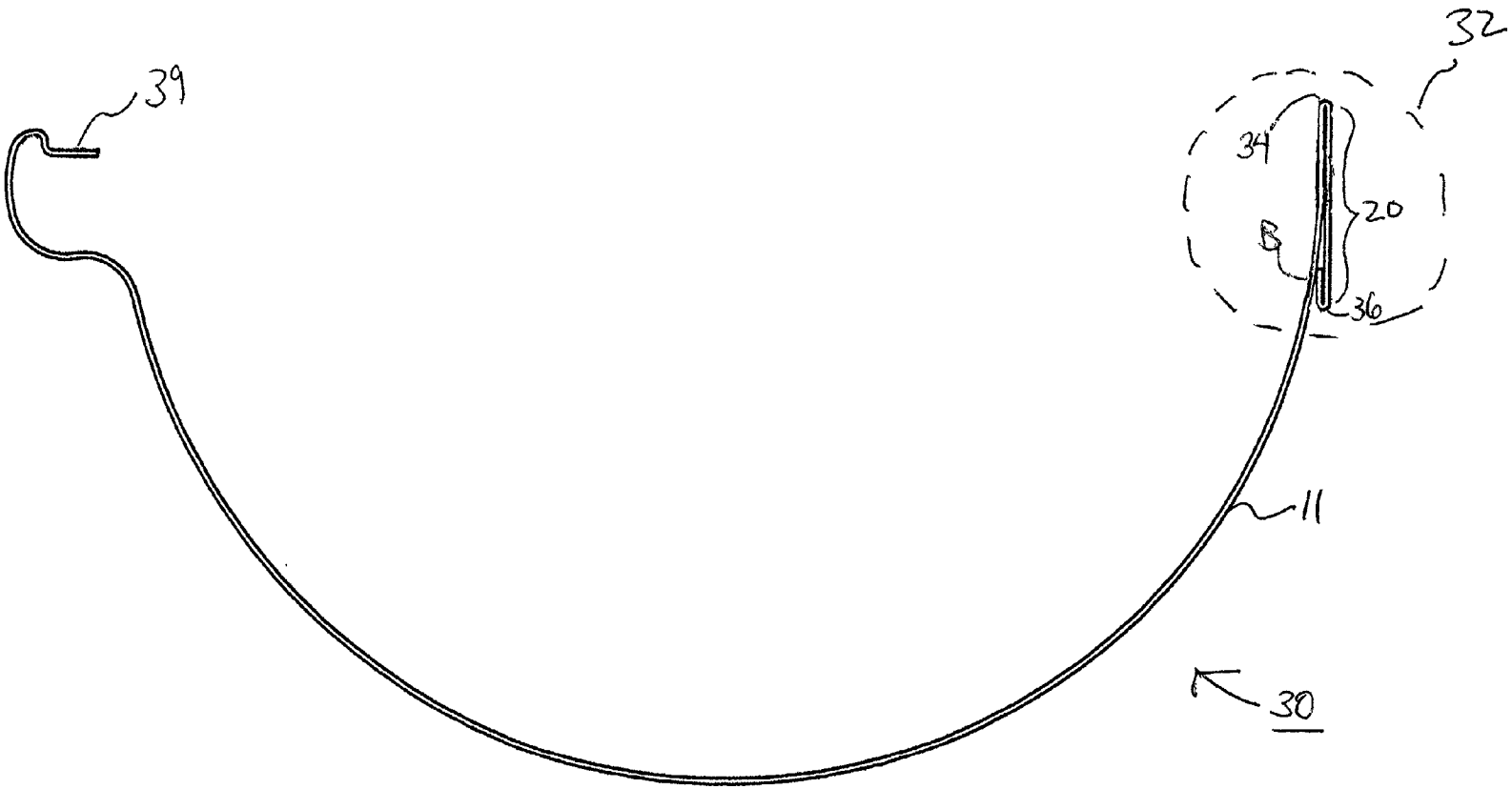
FIG. 3 depicts a preferred embodiment of the present invention.
Figure 4:
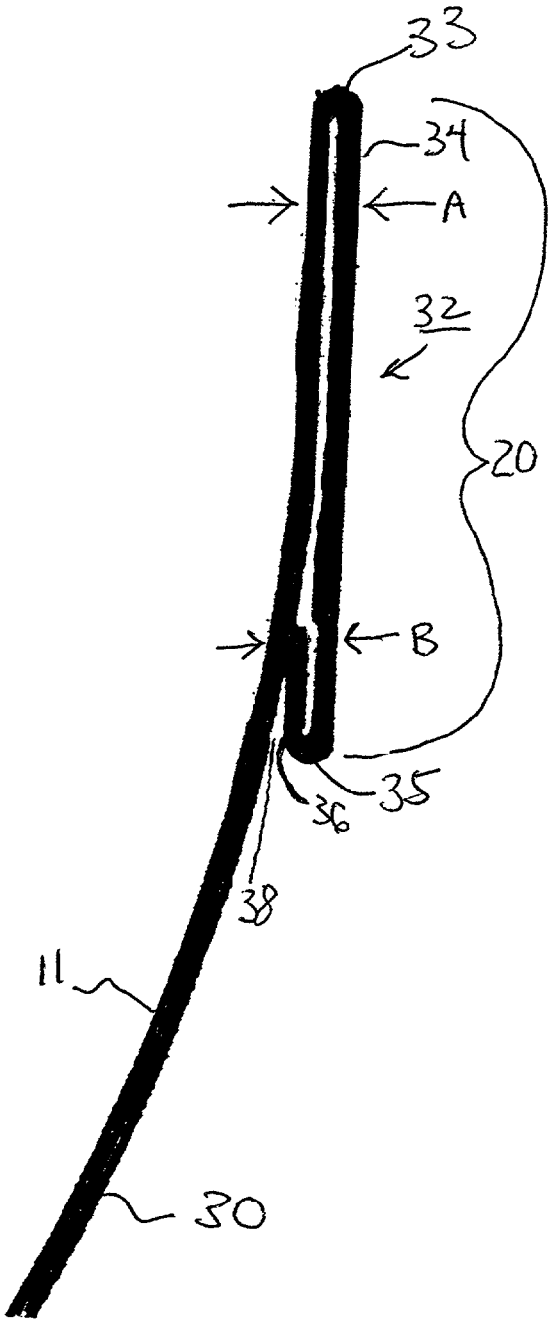
FIG. 4 depicts a preferred embodiment of the present invention.

FIGS. 3 and 4 depict a preferred embodiment of the present invention. In depicted trough 30 comprised from trough material 11, a mounting structure 32 is depicted in accordance with the present invention. Mounting structure 32 exhibits at least two folds. A first (or outer) fold 34 in trough material 11 is imposed by bending trough material 11 at the upper extent of mounting structure 32 and a second (or inner) fold 36 is imposed at a lower extent of mounting structure 32 to create mounting field 20 on the backside of trough 30. Those of skill will recognize that folds 34 and 36 may be creases, folds, or bends or similar impositions on material 11. This creates a double metal layer (depicted by reference A) consisting of the thicknesses of the metal trough material of trough 30 and outer fold 34 and a triple metal layer (depicted by reference B) comprised of the thicknesses of the trough material, outer fold 34 and inner fold 36. This also creates, in a preferred embodiment, gap 38 which is an optional feature of the present invention. The front containment wall border area of trough 30 of FIG. 3 is depicted with an inwardly projecting containment shelf 39 that is described in co-pending U.S. application Ser. No. 09/880,412 owned by the assignee of the present invention.

The entire extent of mounting field 20 need not rest against the building from which runoff is collected. The assignee of the present invention has used an aluminum alloy as well as copper-based metals for trough material 11 but as those in the field will understand, other materials may be employed to advantage with the present invention.

In a preferred embodiment, outer fold 34 extends from apex 33 to apex 35 of inner fold 36 while inner fold 36 extends from apex 35 to its end 37. To preserve clarity in the figures, end 37 of inner fold 36 is shown in FIG. 6.

There are several sizes of half-round gutter trough available. For example, the assignee of the present invention offers 6" half-round troughs. These and other sizes of troughs may be fabricated in conformity with the present invention using standard sized materials (i.e., coil stock of approximately 11 and ⅞ inches in width in the Western U.S. and 11 and ¾ inches in parts of the Eastern U.S.). The use of standard sized materials with the present invention is of significant advantage in fabrication and cost administration.

Figure 5:
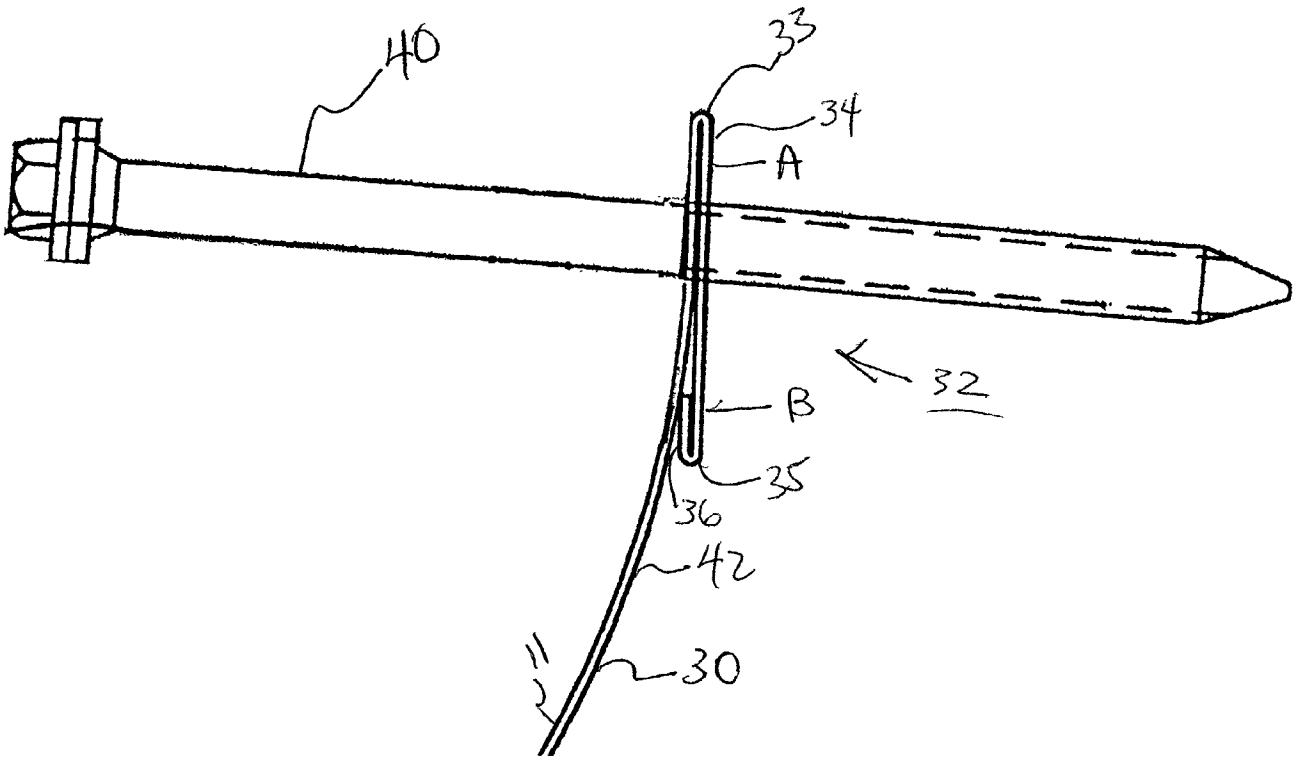
FIG. 5 depicts a preferred embodiment of a mounting structure employed in a preferred embodiment of the present invention.

FIG. 5 depicts a preferred mounting structure 32 penetrated by fastener 40 which may be a screw, nail, spike or other similar fastening device. Fastener 40 passes below the apex 33 of outer fold 34 and above apex 35 of inner fold 36.

Figure 6:
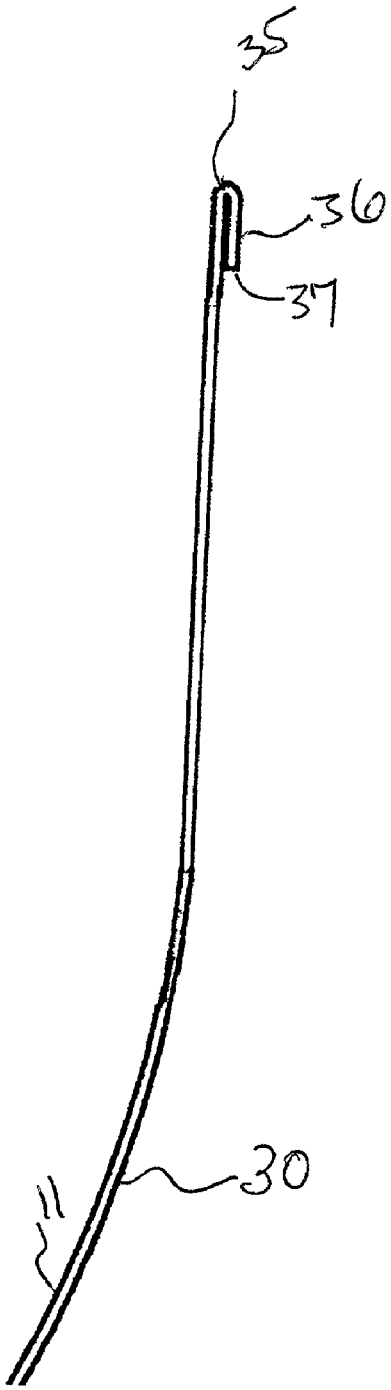
FIG. 6 illustrates, in a preferred embodiment, a first step in formation of a preferred mounting structure in accordance with the present invention.

FIG. 6 illustrates, in a preferred embodiment, a first step in formation of mounting structure 32 in accordance with the present invention. In the preferred embodiment of the method, inner fold 36 is created first by folding over trough material 11 to the outside surface 39 of the trough. It should be understood that the process of forming a trough in accordance with the present invention may be implemented in a forming machine devised to impose the appropriate folds or bends in the proper sequence. Such forming machinery will generally also simultaneously form the trough itself.

Inner fold 36, in a preferred embodiment, doubles over approximately 0.200" of trough material 11 as measured from apex 35 of inner fold 36 to the end 37 of inner fold 36. Inner fold 36 may double over between 0.050" and 0.250" of material with a fold over of 0.200" being found to be preferable in light of the constraints of using standard sized materials in fabrication of trough 30. Then preferably, approximately 1.0 inches below apex 35 of inner fold 36, trough material 11 is then bent over again to create outer fold 34. This is a preferred process for creating the double layer A and triple layer B. The recited dimensions have been found to be preferable by the assignee of the present invention to allow standard sized materials to be employed in the configuration of embodiments of the present invention. Those of skill in the field will note however, that other relative dimensions for folds 34 and 36 will also provide satisfactory results and mounting field 20 extending between apex 33 and apex 35 may, for example, be between ½ and 4 inches in extent from apex 33 and apex 35 and still use standard materials. Some may prefer to use specialized materials for fabrication of trough 30 and in those cases, mounting field 20 may exceed the range of between ½ and 4 inches from apex 33 of fold 34 to apex 35 of fold 36.

Although the present invention has been described in detail, it will be apparent to those skilled in the art that the invention may be embodied in a variety of specific forms and that various changes, substitutions and alterations can be made without departing from the spirit and scope of the invention. The described embodiments are only illustrative and not restrictive and the scope of the invention is, therefore, indicated by the following claims.

I claim:

1. An arcuate trough employed in rain diversion systems, the trough comprising:

an inside surface and an outside surface;

metallic material; and a mounting structure integral with the trough and formed of metallic material, the mounting structure comprising:

an inner fold of metallic material, an outer fold of metallic material, the outer fold extending from an apex corresponding to the outer fold to an apex corresponding to the inner fold the inner fold being disposed between the outer fold and the outside surface of the trough, the inner fold of metallic material and the outer fold of metallic material forming a double metal layer.

2. The trough of claim 1 in which a fastener penetrates the mounting structure between the apex corresponding to the inner fold and the apex corresponding to the outer fold.

3. The trough of claim 1 in which the metallic material is aluminum alloy.

4. The trough of claim 1 in which the metallic material is copper.

5. The trough of claim 1 in which the trough is half-round.

6. The trough of claim 1 in which the inner fold extends a distance from the apex corresponding to the inner fold to the end of the inner fold, the distance being in the range of between 0.050 and 0.250 inches.

7. The trough of claim 1 in which the outer fold extends a distance from the apex corresponding to the outer fold to the apex corresponding to the inner fold, the distance being in the range of between ½ and 4 inches.

* * * * *

UNITED STATES PATENT AND TRADEMARK OFFICE

CERTIFICATE OF CORRECTION

PATENT NO. : 7,010,887 B2
APPLICATION NO. : 10/117755
DATED : March 14, 2006
INVENTOR(S) : A. B. Walters It is certified that error appears in the above-identified patent and that said Letters Patent is hereby corrected as shown below:

On the cover page, item (73), the Assignee "Senox Corpration" should read --Senox Corporation--.

Signed and Sealed this
Seventh Day of August, 2012

David J. Kappos

David J. Kappos
*Director of the United States Patent and Trademark Office*